US008157506B2

(12) United States Patent
Bart et al.

(10) Patent No.: US 8,157,506 B2
(45) Date of Patent: Apr. 17, 2012

(54) DEVICE FOR SUPPLYING VENTILATION AIR TO THE LOW PRESSURE BLADES OF A GAS TURBINE ENGINE

(75) Inventors: Jacques Rene Bart, Soisy sur Seine (FR); Didier Rene Andre Escure, Nandy (FR); Stephane Rousselin, Hericy (FR)

(73) Assignee: SNECMA, Paris (FR)

( * ) Notice: Subject to any disclaimer, the term of this patent is extended or adjusted under 35 U.S.C. 154(b) by 1209 days.

(21) Appl. No.: 12/167,541

(22) Filed: Jul. 3, 2008

(65) Prior Publication Data

US 2009/0304495 A1 Dec. 10, 2009

(30) Foreign Application Priority Data

Jul. 6, 2007 (FR) ..... 07 04918

(51) Int. Cl.
*F02C 7/12* (2006.01)

(52) U.S. Cl. ..... 415/116

(58) Field of Classification Search ..... 416/116
See application file for complete search history.

(56) References Cited

U.S. PATENT DOCUMENTS

| | | | | |
|---|---|---|---|---|
| 3,356,339 | A | 12/1967 | Thomas et al. | |
| 6,392,313 | B1 * | 5/2002 | Epstein et al. | 290/52 |
| 7,766,607 | B2 * | 8/2010 | Charier et al. | 415/115 |
| 7,775,764 | B2 * | 8/2010 | Snowsill et al. | 415/115 |
| 2005/0214109 | A1 * | 9/2005 | Grande et al. | 415/90 |
| 2007/0137221 | A1 * | 6/2007 | Charier et al. | 60/806 |

FOREIGN PATENT DOCUMENTS

| | | | |
|---|---|---|---|
| DE | 199 50 109 | A1 | 4/2001 |
| EP | 1 264 964 | A1 | 12/2002 |

* cited by examiner

*Primary Examiner* — Richard Elms
*Assistant Examiner* — Harry W Byrne
(74) *Attorney, Agent, or Firm* — Oblon, Spivak, McClelland, Maier & Neustadt, L.L.P.

(57) ABSTRACT

A device for supplying ventilation air to a turbine rotor of a gas turbine engine including a first turbine disk, a second turbine disk, and a downstream shell ring together forming a one-piece drum is disclosed. The second turbine disk includes cavities machined in the rim to house the turbine blades, where the blades are axially retained by axial retaining segments. The downstream shell ring has at least one aperture drilled therethrough, downstream of the rim, which places an internal volume of the drum in fluid communication with at least one of the cavities via a passage formed in the segments.

9 Claims, 4 Drawing Sheets

DEVICE FOR SUPPLYING VENTILATION AIR TO THE LOW PRESSURE BLADES OF A GAS TURBINE ENGINE

BACKGROUND OF THE INVENTION AND DESCRIPTION OF THE PRIOR ART

The present invention relates to the field of turbomachines. It is aimed at the ventilation of the low-pressure turbine blades in a twin-spool gas turbine engine.

In turbomachines it is common practice to use air bled from the high-pressure, HP, compressor to cool components located in a hotter environment. These may include the HP turbine blade, bores, disks, etc.

The low-pressure, LP, turbine is one of the ventilated regions: in particular, it is contrived for air to cool the blade attachments by flowing between the blade root, its attachment and the rim of disk.

FIG. 1 depicts the turbine section of a twin-spool turbine engine. This section comprises an HP turbine stage 2 and a set of LP turbines downstream of the nozzle 4 situated between the stage 2 and the first stage of the LP turbine. The entire LP turbine here is made up of four disks bolted together to form a module. Each disk comprises a shell ring on either side of its plane. The shell rings of two adjacent disks are bolted together. Flow straighteners 5 are inserted between the various stages.

FIG. 2 depicts how the blades are attached to the LP turbine disks 3. Cavities 31 are machined at the periphery on a rim of the disks and the blades 6 are slid into these cavities and axially immobilized by an axial retaining segment 8. The segments are in the shape of arcs of a circle and are positioned bearing against one face of the rim of the disk between a hook 61 and that face 62 of the blade roots to which the hook is attached. They restrain the blades against any axial movement. The segments are scalloped and are slid into a peripheral groove 32. As can be seen, the segment is first of all angularly offset to allow the root of the blades to be inserted into its cavity then the segment is moved angularly so that the tops of the scalloped part fit in between the face of the root and the hook of each blade. As the segment is held in the groove, the assembly is axially immobilized.

Furthermore, the flow of ventilation air depicted in FIGS. 3 and 4, which illustrate two different designs of the prior art, comprises an air stream illustrated by the arrow F emanating from the nozzle DBP1 upstream of the first LP turbine stage which, for each stage, is guided between the shell ring V1 of the disk and the sealing shell ring VE, flows around the axial retaining segments 8, and reaches the turbine blade attachments.

With a view to reducing mass and to simplifying the design of the machine, the disks tend to be grouped together in pairs or in greater numbers in order to produce one-piece drums. The elements are welded together and form a unit. As can be seen in FIG. 5, a drum is made up of two disks 11 and 12 connected by a shell ring 13 on which the sealing elements 13E are created. A shell ring 14 is secured to the downstream disk 12 and comprises orifices 14A through which means of attachment, bolts not depicted in the figure, to an adjacent other group or disk can pass. In the case of a structure such as this, shell rings for the sealing elements are not needed because these are incorporated into the drum. The disks moreover have the same structure as in the earlier embodiments and the blades of the second stage of the group of this figure are also mounted in the same way. What that means in the case of the disk 12 is that the blades 6 are housed in cavities formed in the rim 12J and are axially retained by retaining segments 8 slipped both into a radial groove 12R perpendicular to the axis of the rotor 12 and between the rear face 62 of the blade root and the associated hook 61 thereof.

With a solution of this type, the issue of conveying ventilating air as far as the blade attachments arises. Air is bled from inside the drum and has to get as far as the second disk 12 of the drum. The problem does not arise in respect of the first disk. A solution whereby the rim 12J of the disk 12 is pierced at the cavity so that air can reach the attachments, as indicated by P, cannot be effected because of the stress concentrations that the drillings would cause.

SUMMARY OF THE INVENTION

The applicant company has set itself the objective of finding a solution that would, in the case of drums of disks, allow for blade attachment ventilation and axial blade retention.

According to the invention, this objective is achieved using a device for supplying ventilation air to a turbine rotor of a gas turbine engine comprising a first and a second turbine disk and a downstream shell ring together forming a one-piece drum, the second turbine disk comprising cavities to house the turbine blades, the blades being axially retained by axial retaining segments. The device is one wherein at least one drilling is made in the shell ring placing the inside of the drum in communication with at least some of said cavities via a passage through the segments.

This passage can be created in different ways. According to a first embodiment, the axial retaining segments have an annular channel open laterally onto said drilling and onto the cavities.

According to another embodiment, the segments comprise radial channels produced in particular by machining.

BRIEF DESCRIPTION OF THE DRAWINGS

Other features and advantages will emerge from the following description of some exemplary embodiments given with reference to the attached drawings in which.

DESCRIPTION OF THE PREFERRED EMBODIMENTS

Figure 1:
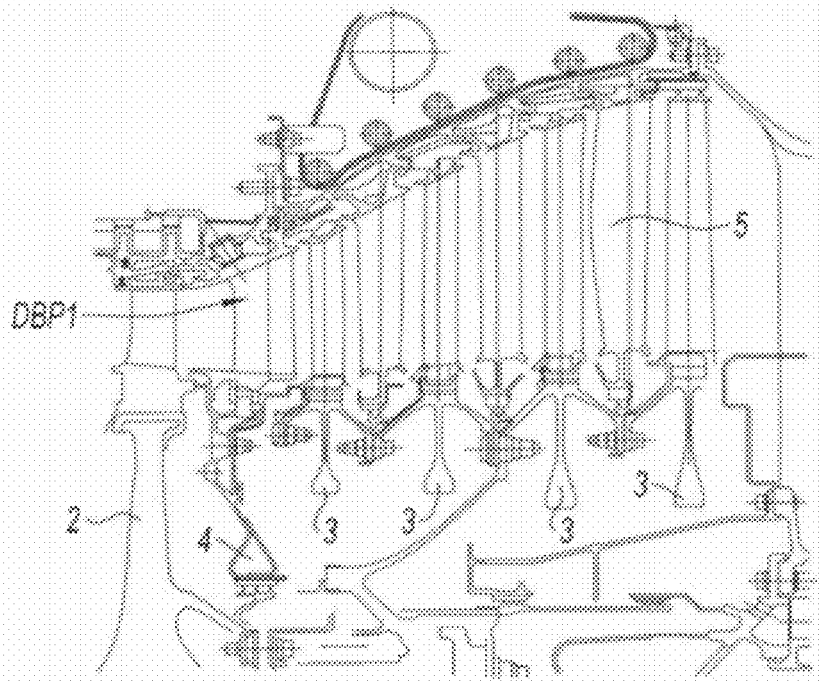
FIG. 1 shows, in axial section, part of a gas turbine engine.
Figure 2:
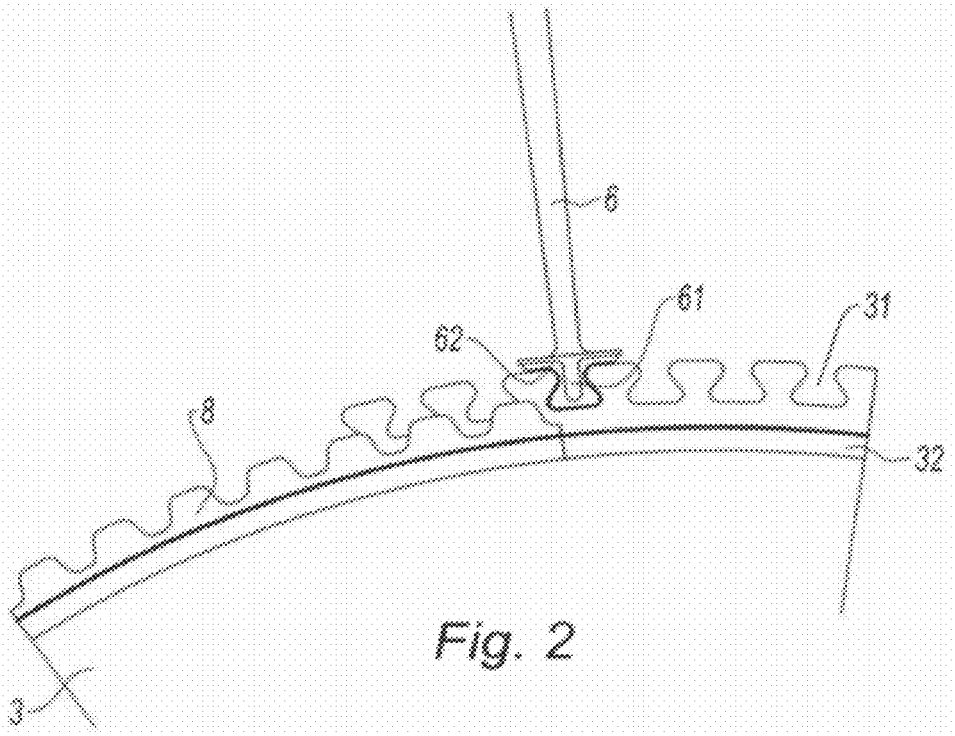
FIG. 2 shows how the blades are mounted on a disk.
Figure 3:
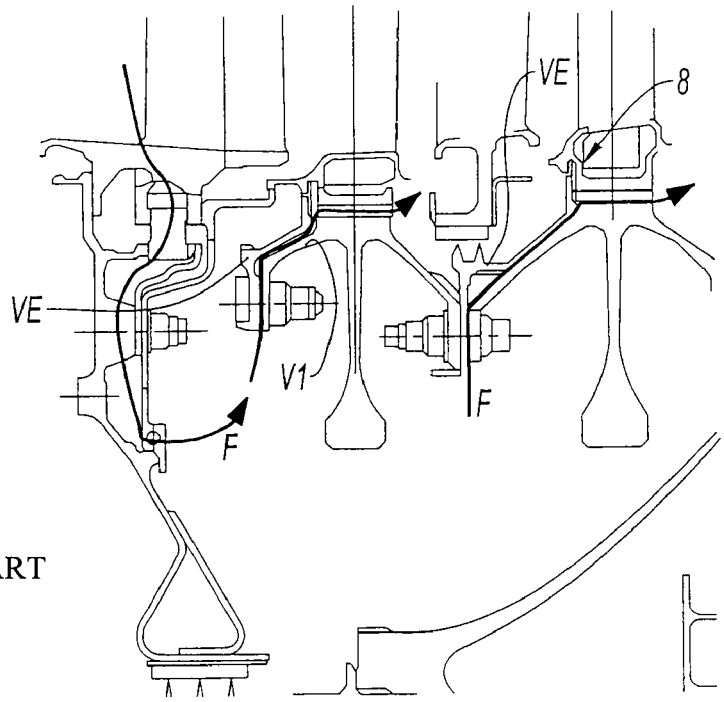
BACKGROUND ART Fig. 3
FIG. 3 shows a LP turbine setup of the prior art with the circulation of air for ventilating the blade roots.
Figure 4:
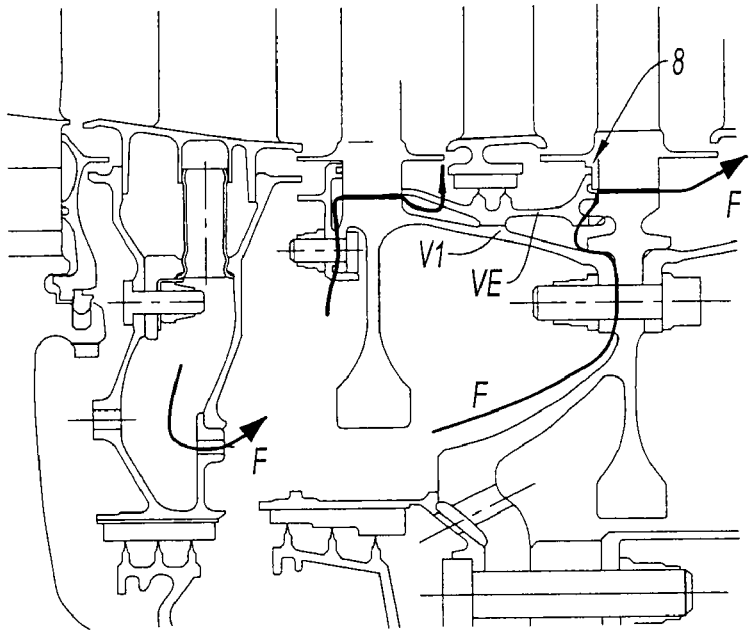
BACKGROUND ART Fig. 4
FIG. 4 shows another LP turbine setup of the prior art with the circulation of the air for ventilating the blade roots.
Figure 5:
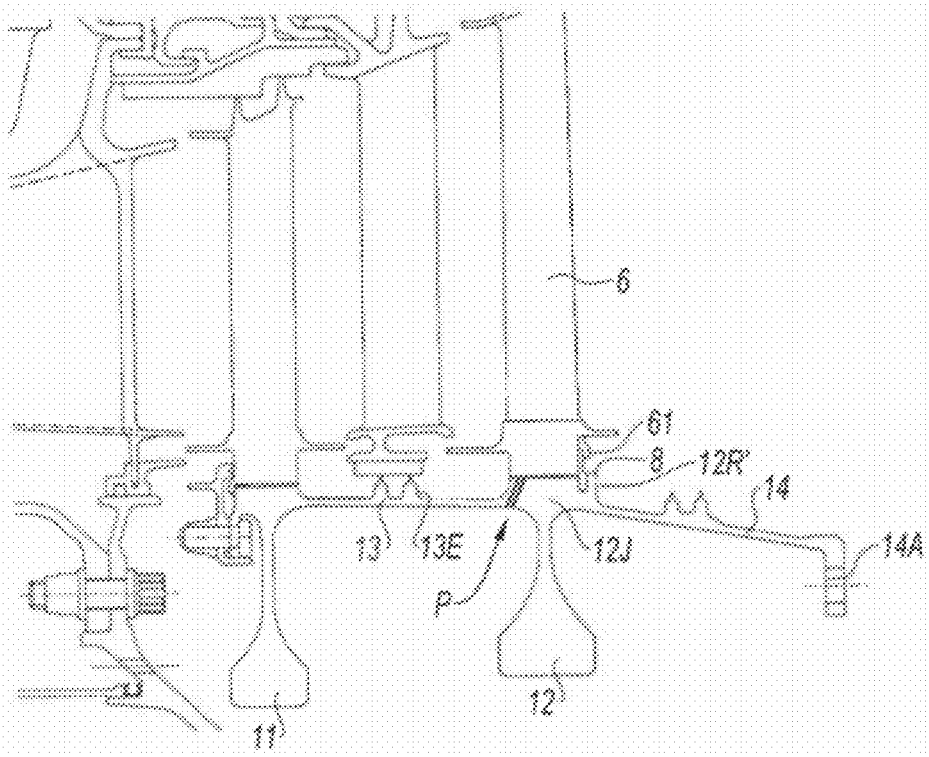
FIG. 5 shows a one-piece turbine drum.
Figure 6:
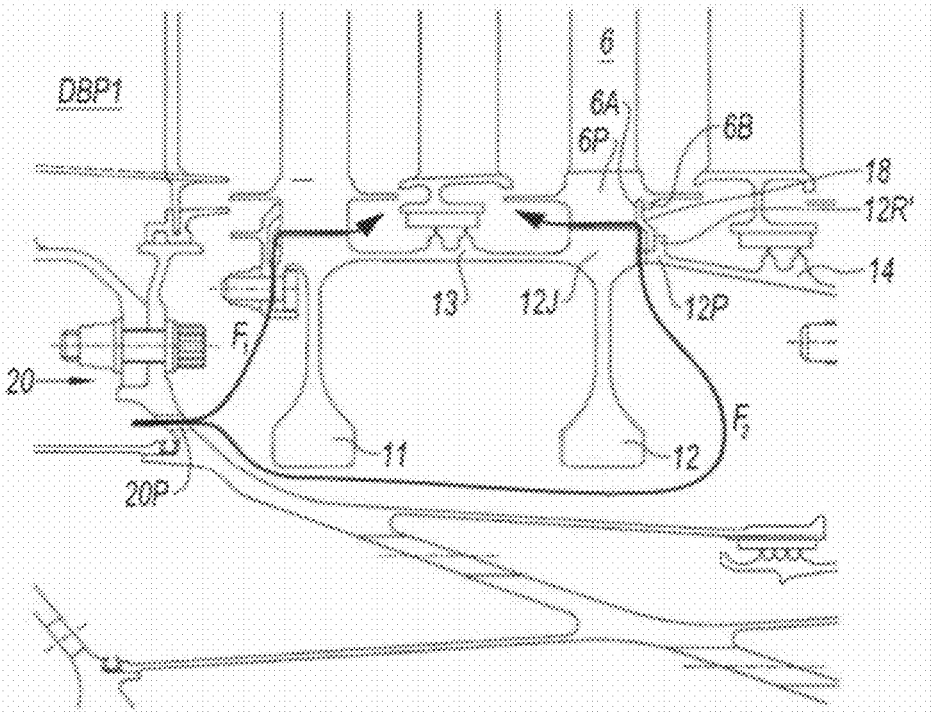
FIG. 6 shows a one-piece turbine drum incorporating the solution of the invention.
Figure 7:
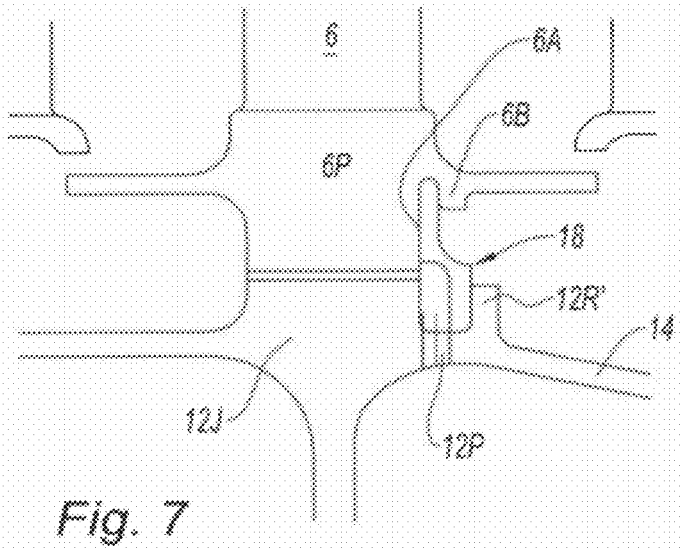
FIG. 7 shows a detail of FIG. 6 with the blade root attachment.
Figure 8:
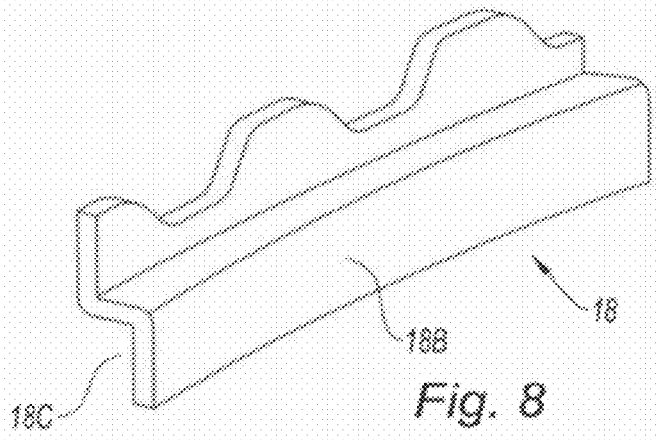
FIG. 8 shows part of an axial retaining segment in the solution according to the invention.

FIG. 6 depicts, in axial section, part of the LP turbine incorporating the solution of the invention. The one-piece drum 10 comprises the disks 11 and 12 connected by a shell ring 13 and with a rear shell ring 14. The elements are one piece in that they are either machined to form a one-piece drum or welded together. The rim 12J of the disk 12 comprises axial cavities into which the roots 6P of the blades 6 are slid axially. To hold them axially in position, the blades have a hook 6B downstream of the rear transverse face 6A of the root 6P.

Air needs to circulate between the internal volume of the drum 10 and the closed end of the cavities in the space formed with respect to the blade roots in order to ventilate these. According to the invention, a drilling 12P is created in the wall downstream of the rim 12J of the disk through the downstream shell ring 14. This drilling is radial and places the internal drum volume in communication with the closed end of a groove 12R'. This groove is radially open. It is created between the rim 12J and a transverse flange parallel to the rim 12J.

The axial retaining segments 18 are housed in this groove 12R'. These arc-shaped segments extend radially along the downstream face of the rim and conceal the downstream faces 6A of the blade roots 6P. The segments are slid between the downstream face 6A of the roots 6P and their corresponding downstream hook. They thus immobilize the blade roots against any axial movement. The base 18B of the segments is thick and occupies the width of the groove 12R'.

According to a first embodiment, an annular channel 18C is machined in the thickness of the base 18B. This channel places the drillings 12P in communication with the closed ends of the cavities and thus forms a radial then axial passage 18P. In operation, air flows from the region upstream of the turbine rotor. It passes through the stator 20 via a passage 20P and splits into several streams. The stream F1 is guided toward the passage created between the shell ring and a flange used to fix the shell ring to the first disk 11, in order to ventilate the cavities of the disk 11. Another part F2 of the stream passes between the central openings of two disks 11 and 12, and the stator 20, sweeps up along the downstream face of the disc 12 and enters the drillings 12P. Because the drillings communicate with the closed end of the groove at the channel 18C, air finds itself in the annular channel 18C from where it is distributed to the spaces between the blade roots and the closed end of the cavities. On leaving this space, the air is then guided in the gas flow.

By piercing the drum in the region located downstream of the rim of the disc and by suitable design of the axial retaining segments, enough ventilating air can then be supplied without this being at the expense of the strength of the disk. The mass cost on the thickness of the base 18B is small or even nonexistent. The segments performs its axial retaining function with no loss of effectiveness.

Figure 9:
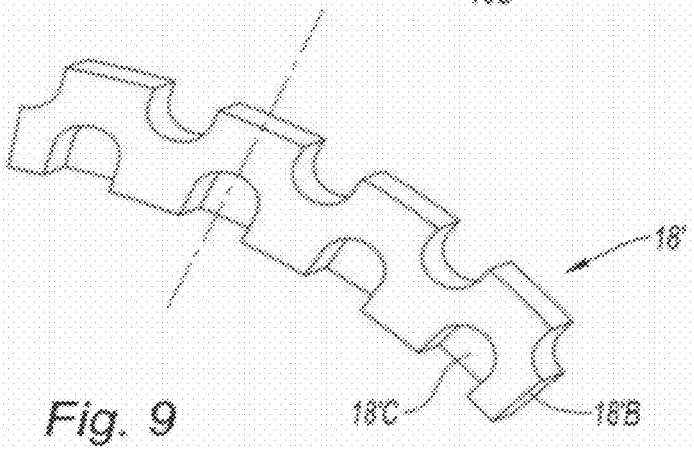
FIG. 9 shows part of an alternative form of retaining segment in the solution according to the invention.

FIG. 9 depicts an alternative form of embodiment of the axial retaining segment. This segment 18', instead of having a continuous channel formed in the base 18'B, comprises a plurality of blind lunulae 18'C machined from the mass of the base 18'B. These radial lunulae communicate, on one side, with the drillings 12P and are axially open on the same side as the face bearing against the rim 12J in the region of the closed ends of the cavities. They form the passages 18'P. The blade attachments are ventilated in the same way as before. Air from the turbine upstream nozzle flows into the drum; part of this stream is carried through the drillings 12P and is then guided by the axial retaining segments into the empty spaces between the closed ends of the cavities and the roots of the blades.

The invention claimed is:

1. A device for supplying ventilation air to a turbine rotor of a gas turbine engine, comprising:

a first turbine disk, a second turbine disk, and a downstream shell ring together forming a one-piece drum, wherein:

the second turbine disk includes cavities machined in a rim of the second turbine disk to house turbine blades, the turbine blades are axially retained by axial retaining segments, the downstream shell ring includes at least one aperture therethrough, the at least one aperture disposed downstream of the rim, a flow passage of the axial retaining segments is in fluid communication with an internal volume of the one-piece drum through the at least one aperture, and at least one of the cavities machined in the rim of the second turbine disk is in fluid communication with the flow passage of the axial retaining segments.

2. The device as claimed in claim 1, wherein the passage is defined by at least one concave portion of the segments.

3. The device as claimed in claim 1, wherein the axial retaining segments comprise a base housed in a groove formed in the drum.

4. The device as claimed in claim 3, wherein the axial retaining segments comprise an annular channel in the base, the channel being radially open onto the at least one aperture and axially open onto the at least one of the cavities in the rim of the second turbine disk.

5. The device as claimed in claim 3, which wherein the axial retaining segments comprise a plurality of blind radial lunulae machined in the base.

6. A gas turbine engine turbine rotor comprising a device for supplying ventilating air as claimed in claim 1.

7. A gas turbine engine comprising a turbine rotor as claimed in claim 6.

8. The device as claimed in claim 1, wherein at least two members of the group consisting of the first turbine disk, the second turbine disk, and the downstream shell ring are welded together.

9. The device as claimed in claim 1, wherein at least two members of the group consisting of the first turbine disk, the second turbine disk, and the downstream shell ring are machined from a single piece.

* * * * *